US007535357B2

(12) United States Patent
Enitan et al.

(10) Patent No.: US 7,535,357 B2
(45) Date of Patent: May 19, 2009

(54) PROXIMITY ALARM SYSTEM FOR ARTICLES

(76) Inventors: Olusola Enitan, 48 Beulah Grove, Croydon CR02QW (GB); Wale Ajayi, 48 Beulah Grove, Croydon CR02QW (GB)

( * ) Notice: Subject to any disclaimer, the term of this patent is extended or adjusted under 35 U.S.C. 154(b) by 300 days.

(21) Appl. No.: 11/554,200

(22) Filed: Oct. 30, 2006

(65) Prior Publication Data

US 2007/0096933 A1 May 3, 2007

(30) Foreign Application Priority Data

Oct. 31, 2005 (NG) ..... RP16231
Aug. 4, 2006 (NG) ..... RP16545

(51) Int. Cl.
*G08B 13/14* (2006.01)

(52) U.S. Cl. ..... 340/571; 340/539.11; 340/541; 455/550.1; 455/575.1; 379/39

(58) Field of Classification Search ..... 340/539.11, 340/539.23, 539.32, 541, 568.1, 571; 455/550.1, 455/575.1, 575.4, 575.6, 575.8, 550; 379/37, 379/39, 40, 42
See application file for complete search history.

(56) References Cited

U.S. PATENT DOCUMENTS 4,748,654 A * 5/1988 Gray ..... 379/40
D392,202 S 3/1998 Nitzberg
5,796,338 A 8/1998 Mardirossian
5,900,061 A * 5/1999 Wright ..... 118/300
6,265,974 B1 * 7/2001 D'Angelo et al. ..... 340/568.1
6,294,995 B1 9/2001 Patterson
7,002,473 B2 * 2/2006 Glick et al. ..... 340/572.1
7,248,892 B2 * 7/2007 White et al. ..... 455/550.1
2002/0126012 A1 9/2002 Page
2003/0027547 A1 * 2/2003 Wade ..... 455/404
2004/0041708 A1 3/2004 Greenwaldt
2004/0051647 A1 3/2004 Chen
2006/0202840 A1 * 9/2006 Korbonski ..... 340/573.4
2008/0074951 A1 * 3/2008 Hubicki ..... 368/14

FOREIGN PATENT DOCUMENTS

NG RP16231 B1 11/2005
NG RP16545 B1 8/2006

OTHER PUBLICATIONS

Consultation on a National Scheme to Curtail Mobile Phone Theft, Event Presentation, Aug. 30, 2006, p. 12, http://www.ncc.gov.ng/cab/Curtail%20Theft/presentation-mobile%20theft%20-ncc.pdf , Nigerian Communication Commission, Lagos, Nigeria.

* cited by examiner

*Primary Examiner*—George A Bugg
*Assistant Examiner*—Edny Labbees

(57) ABSTRACT

This patent discloses a proximity alarm system for an article. The proximity alarm system may include a transmitter to attach to the article and a receiver having an alarm, a set of combination dials, and a deactivation button. When the article is a cell phone, the receiver may attach to a person's belt and hold the cell phone. The transmitter and receiver may be in wireless communication with each by infrared radiation signals and/or radio frequency signals. When the communication between the transmitter and receiver is interrupted by distance, objects, or otherwise interfered with, the receiver may generate a sound, visible light, and/or vibratory alarm. The alarm may be quashed by turning the receiver off, moving the article closer to the receiver, and/or turning the set of combination dials to a secret predetermined number and pressing the deactivation button.

18 Claims, 12 Drawing Sheets

TRANSMITTER CIRCUIT (Infrared Radiation Signals)

RECEIVER CIRCUIT
(Infrared Radiation Signals)

TRANSMITTER CIRCUIT 1106
(Radio Frequency Signals)

RECEIVER CIRCUIT 1200
(Radio Frequency Signals)

PROXIMITY ALARM SYSTEM FOR ARTICLES

RELATED APPLICATIONS

Priority is claimed to RP16231 filed in Nigeria on Oct. 31, 2005 and to RP16545 filed in Nigeria on Aug. 4, 2006, the entire disclosures of which are incorporated herein by reference.

BACKGROUND

1. Field

The information disclosed in this patent relates electrical communication devices having condition responsive indicators, including an alarm that may be automatically operated to produce humanly perceptible signals in response to changes in communication between a transmitter and a receiver.

2. Background Information

In the last twenty years, information exchange has moved to the forefront of modern society. To meet consumer information exchange demands, manufacturers produce numerous handheld communication devices, including mobile phones, i-pods, palmtops, laptops, electronic diaries, and digital cameras. These small items are easily lost and, because of the resale value of the device and the information stored therein, there is a black market on which stolen communication devices may be illegally sold.

There is a worldwide epidemic of theft and/or loss of handheld information, communication, and telecommunication (ICT) equipment. Cell phone theft is the most commonly lost or stolen handheld communication device. For example, a cell phone is stolen every 3 minutes in the United Kingdom. In the United States, over 150,000 Samsung handsets were stolen in 2003 alone and recently a thief ran up US$26,000 in unauthorized (mostly international) charges on a cell phone stolen in New York for which the subscriber was liable. MTN Nigeria Communications Ltd. reports that consumers replace an average of 50,000 mobile phones within MTN'S system each month. The theft of cell phones in Nigeria has become so problematic, that the Nigerian Communications Commission (NCC) recently urged owners to safeguard their handsets and held consultation meetings in August 2006 to discuss the need to introduce a national scheme to curtail the theft of mobile phones in Nigeria.

To guard against loss or theft of their cell phone, cell phone users are told to lock their cell phone with a password and keep track of where their cell phone is at all times. However, thieves have sophisticated systems to override cell phone passwords. Moreover, modern life is fast-paced and confusing, and it is easy to lose or misplace small items of value such as a cell phone.

What is needed is a system to alert a user in the event that their handheld communication device becomes lost or stolen.

SUMMARY

This patent discloses a proximity alarm system for an article. The proximity alarm system may include a transmitter to attach to the article and a receiver having an alarm, a set of combination dials, and a deactivation button. When the article is a cell phone, the receiver may attach to a person's belt and hold the cell phone. The transmitter and receiver may be in wireless communication with each by infrared radiation signals and/or radio frequency signals. When the communication between the transmitter and receiver is interrupted by distance, objects, or otherwise interfered with, the receiver may generate a sound, visible light, and/or vibratory alarm. The alarm may be quashed by turning the receiver off, moving the article closer to the receiver, and/or turning the set of combination dials to a secret predetermined number and pressing the deactivation button.

DETAILED DESCRIPTION

Figure 1:
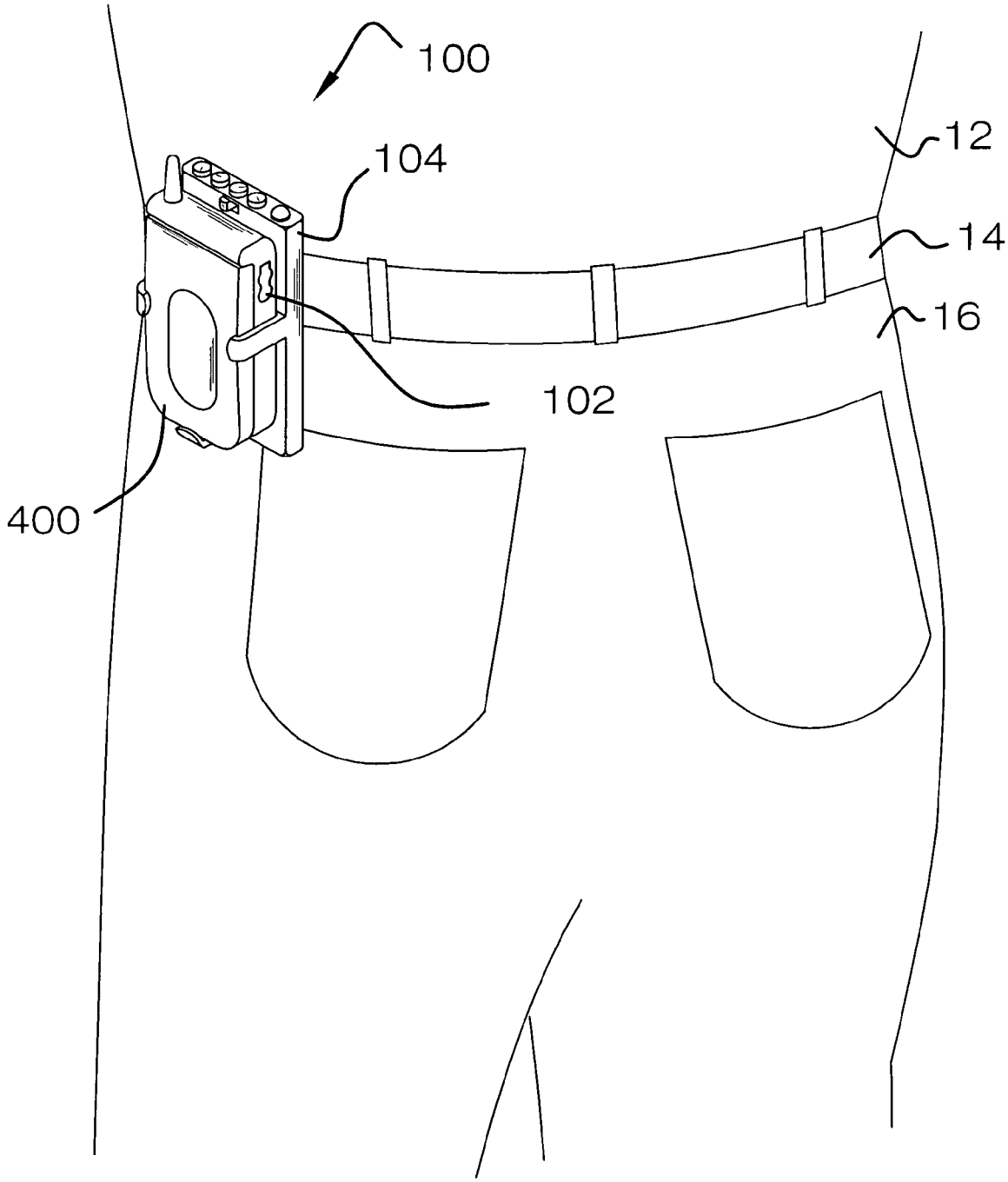
FIG. 1 is an isometric view of a proximity alarm system 100 for an article.
Figure 2:
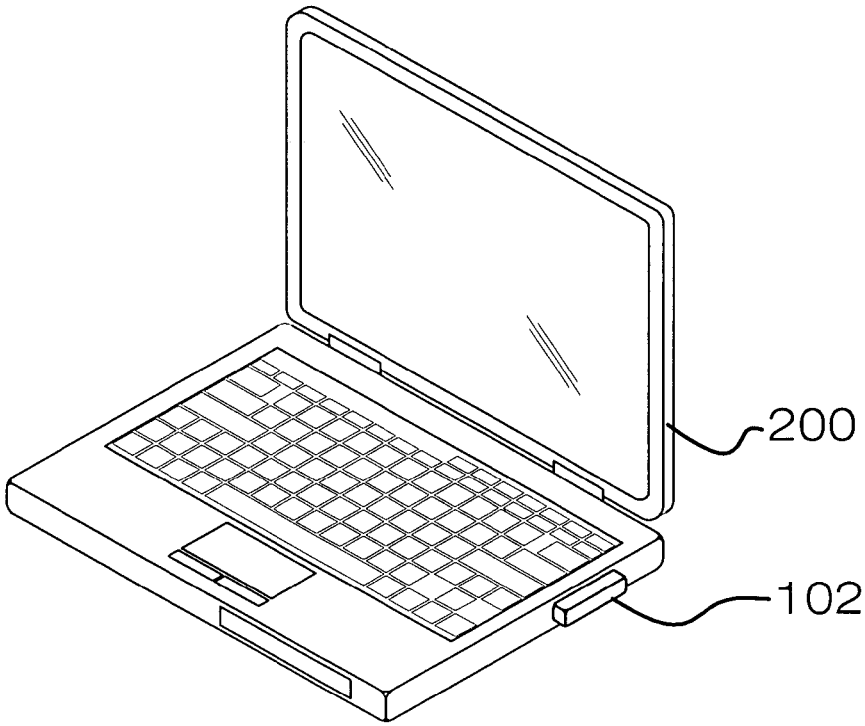
FIG. 2 is an isometric view of a laptop 200.
Figure 3:
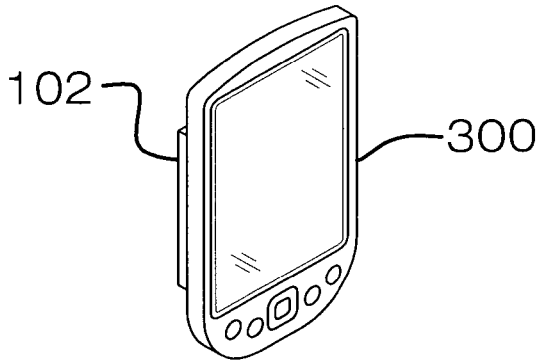
FIG. 3 is an isometric view of a Personal Digital Assistant (PDA) 300.
Figure 4:
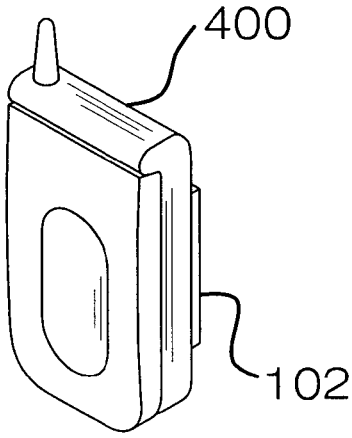
FIG. 4 is an isometric view of a cell phone (handset) 400.

FIG. 1 is an isometric view of a proximity alarm system 100 for an article. Proximity alarm system 100 may function to prevent theft and or loss of electronic and other handheld equipment. In general, proximity alarm system 100 may include a pair of wirelessly connected devices—a transmitter 102 and a receiver 104. Transmitter 102 may be attached to or otherwise embedded in an article, while receiver 104 may be attached to a flip-like material, which may be clipped on the user's belt. Separation of transmitter 102 and receiver 104 by more than a predetermined distance (such as two feet, three feet, or ten feet) may cause an alarm to sound, vibrate, or light. This alarm may prevent the accidental loss or theft of an item attached to the transmitter.

Hand hardware for proximity alarm system 100 may be discussed in connection with FIGS. 1-7. In a first example (FIGS. 8-10), proximity alarm system 100 may be configured to employ infrared radiation signals to control various outputs. In a second example (FIGS. 11-16), proximity alarm system 100 may be configured to employ radio frequency signals to control various outputs.

Transmitter 102 may be attached to an article such as a laptop 200 (see FIG. 2), a Personal Digital Assistant (PDA) 300 (see FIG. 3), a cell phone (handset) 400 (see FIG. 4 and FIG. 1), a palmtop, an internet pod (iPod) portable digital audio player that may include devices utilizing moving picture audio layer 3 (MP3) digital audio compression algorithms, an electronic diary, a digital camera, antique pieces, artworks, priceless jewelry, small but costly household equipment, pets, toddlers, treasures and other small and medium sized articles.

Transmitter 102 may be configured to be in wireless communication with a receiver 104 that may be configured to receive incoming radio signals from transmitter 102. Should transmitter 102 and receiver 104 become separated by a certain distance such as ten feet or should communications between transmitter 102 and receiver 104 otherwise become interrupted, proximity alarm system 100 may generate humanly perceptible auditory and/or vibratory signals to alert a user 12 (FIG. 1) that cell phone 400 may be in the process of being lost or stolen. Transmitter 102 may be configured to be in wireless or direct communication with cell phone 400.

Transmitter 102 may be configured in such a way that transmitter 102 may function off of 2.5 volts when utilized with cell phone 400 and function off 6-9 volts when utilized with a different article. When inserted into cell phone 400, power to transmitter 102 may be supplied by the subscriber identity module (SIM) voltage of cell phone 400. Importantly, this may avoid the need to build a new battery that may be bulky or space consuming. In addition, when inserted into cell phone 400, transmitter 102 may include an external antenna and/or an internal antenna. For infrared radiation signals, the antenna may need to be external to transmit the infrared light. For radio frequency signals, an external antenna may not be needed because of the short transmitting distances involved (i.e. 2 to 3 feet distance between transmitter 102 and receiver 104).

Transmitter 102 may be include a SIM compatible embedded connector that may configure the power source of transmitter 102 to be compatible with a battery of cell phone 400. Transmitter 102 may be in different forms, depending on the article to be protected. For cell phone 400, transmitter 102 may be like a cell phone holder with an expandable clasp on each side, a trapping switch near the bottom, and a belt clip built onto the back.

Figure 5:
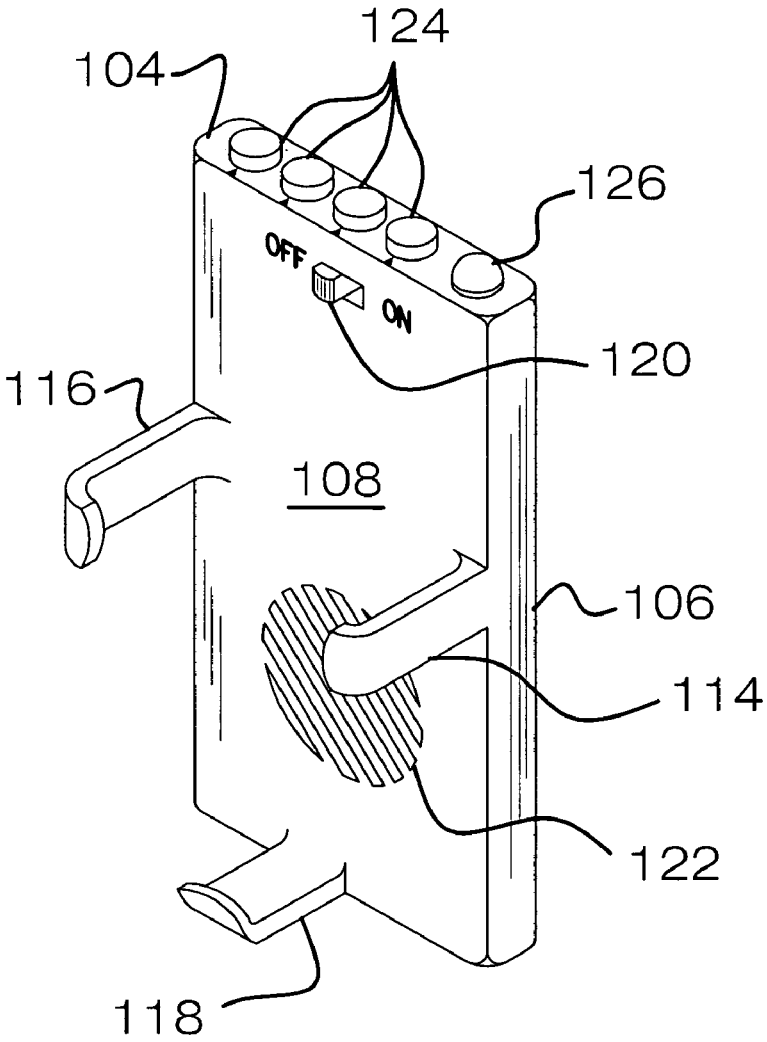
FIG. 5 is a front isometric view of receiver 104.
Figure 6:
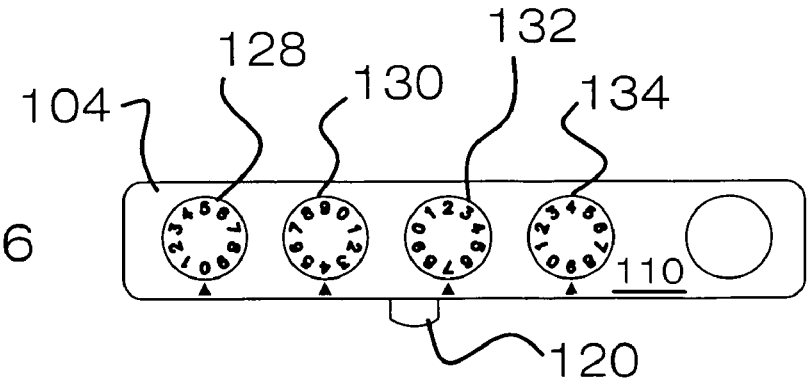
FIG. 6 is a partial top view of receiver 104.
Figure 7:
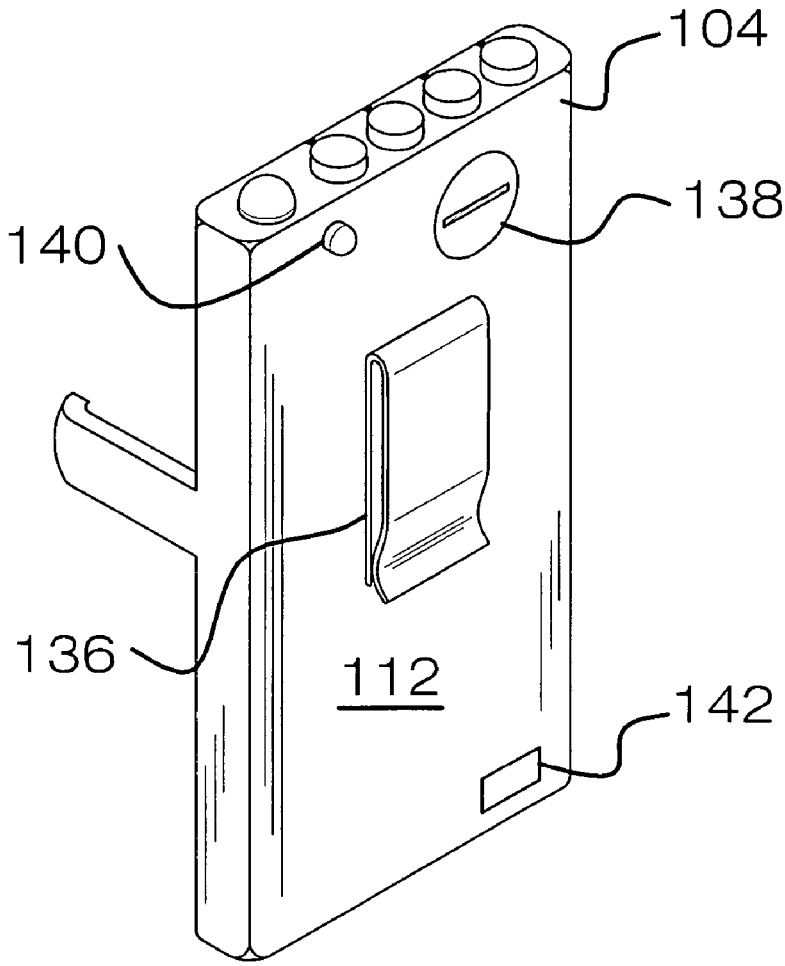
FIG. 7 is a rear isometric view of receiver 104.

FIG. 5 is a front isometric view of receiver 104. FIG. 6 is a partial top view of receiver 104. FIG. 7 is a rear isometric view of receiver 104. Receiver 104 generally may have rectangular shape.

Receiver 104 may include a housing 106 having a front face 108, a top face 110, and a rear face 112. Extending from front face 108 may be a first arm 114 positioned to oppose a second arm 116. First arm 114 and second arm 116 may expand away from each other to receive cell phone 400 and then resiliently return towards each other to retain cell phone 400. A bottom clip 118 extending from front face 108 may function with first arm 114 and second arm 116 to hold cell phone 400 in place.

Receiver 104 may include an alarm circuit (discussed below) that may be triggered-off by a signal from transmitter 102 in cell phone 400. Thus, whenever transmitter 102 and receiver 104 may be separated beyond a two to three foot radius protected area, the alarm circuit may automatically trigger an alarm. Other applications may utilize more distance radii and the protected area may be a function of the length and conductivity of the antenna and the power of transmitter 102. The alarm may be turned off by bring transmitter 102 and receiver 104 back together within the protected area.

Receiver 104 may include an On/Off switch 120 near a top portion of front face 108 and an alarm speaker openwork 122 near a center portion of front face 108 between first clip 114, second clip 116, and bottom clip 118. On/Off switch 120 may include two pieces of metal contacts that touch to make a circuit (On), and separate to break the circuit (Off). On/Off switch 120 may be flush with front face 108, be below front face 108, or extend outward from front face 108. When extended outward from front face 108, On/Off switch 120 may aid bottom clip 118, first arm 114, and second arm 116 in holding cell phone 400 in place.

Receiver 104 may include an electromechanical transducer to convert an electrical signal into sound, such as a multi-tone ringing/alarm. Alarm speaker openwork 122 may be an openwork area in housing 106 through which this sound may emanate. The openwork area of alarm speaker openwork 122 may include diagonal slots enclosed within a circular perimeter.

Extending from top face 110 may be combination dials 124 and a deactivation button 126. Combination dials 124 may include a first dial 128, a second dial 130, a third dial 132, and a fourth dial 134. In one example, combination dials 124 may include a fifth dial. Each combination dial 124 may be marked with numbers zero through nine (FIG. 6) and configured to be rotated so that only one number on each combination dial 124 is closest to front face 108. Each combination dial 124 may cause the number closet to front face 108 to be registered and stored. Collectively, first dial 128, second dial 130, third dial 132, and fourth dial 134 may be positioned to present one set of a sequence of numbers. To deactivate proximity alarm system 100 temporarily, user 12 (FIG. 1) may set each combination dial 124 to a predetermined number (such as 5924) and then press deactivation button 126.

Figure 9:
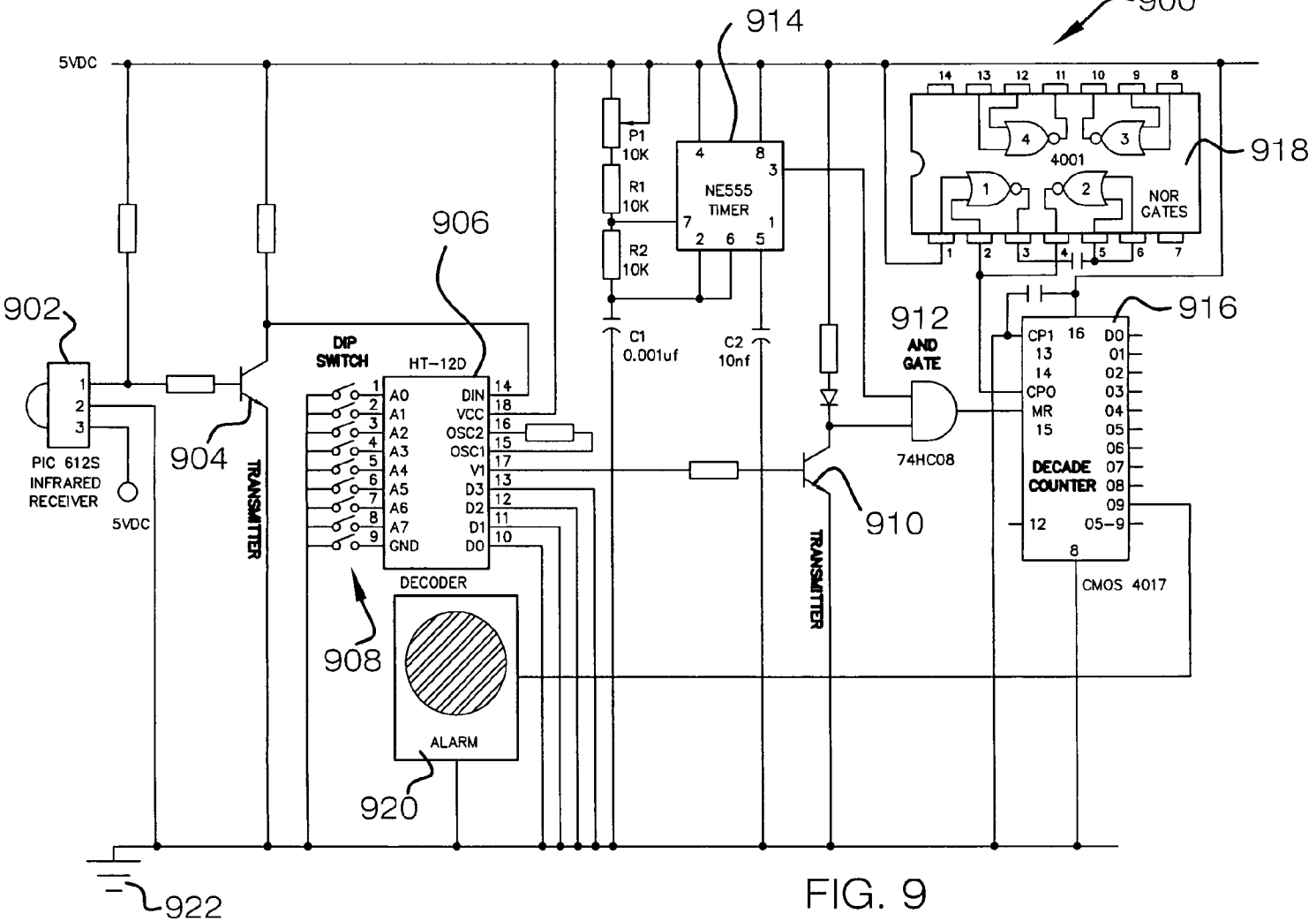
FIG. 9 is a schematic of a receiver circuit 900 for receiver 104.

Deactivation button 126 may serve as an alarm as well. In one example, deactivation button 126 may be clear or translucent to allow a light to emanate upward from deactivation button 126. The light may be a neon flashing light. Deactivation button 126 may serve as a receiver antenna, such as including infrared receiver 902 (FIG. 9).

Receiver 104 may be worn by user 12 (FIG. 1). To achieve this, receiver 104 may include a belt clip 136 (FIG. 7) attached to rear face 112. Belt clip 136 may be any device that grips and holds tightly, such as a U-shape metal or plastic clasp. Belt clip 136 may hook onto a belt 14 (FIG. 1), where belt 14 also may support user pants 16 (FIG. 1). To prevent receiver 104 from being knocked off belt 14, belt clip 114 may be configured to rotate with respect to housing 106.

Receiver 104 additionally may include a battery compartment 138, a battery light emitting diode (LED) 140, and a data port 142. Battery compartment 138 may house a battery (not visible in FIG. 7) that may power receiver 104 and battery LED 140 may provide user 12 with a status on the amount of power left in the battery. Battery LED 140 may be flush with, below, or extend from rear face 112.

Data port 142 may aid in communication data from proximity alarm system 100 and cell phone 400 to an external device. For example, data port 142 may be configured to permit phone users to back up/store/save information on a subscriber identity module (SIM) to a remote location. In the event of loss, theft, or separation of user 12 (FIG. 1) from cell phone 400, this SIM reading capability may be utilized to retrieve remotely stored information.

Figure 8:
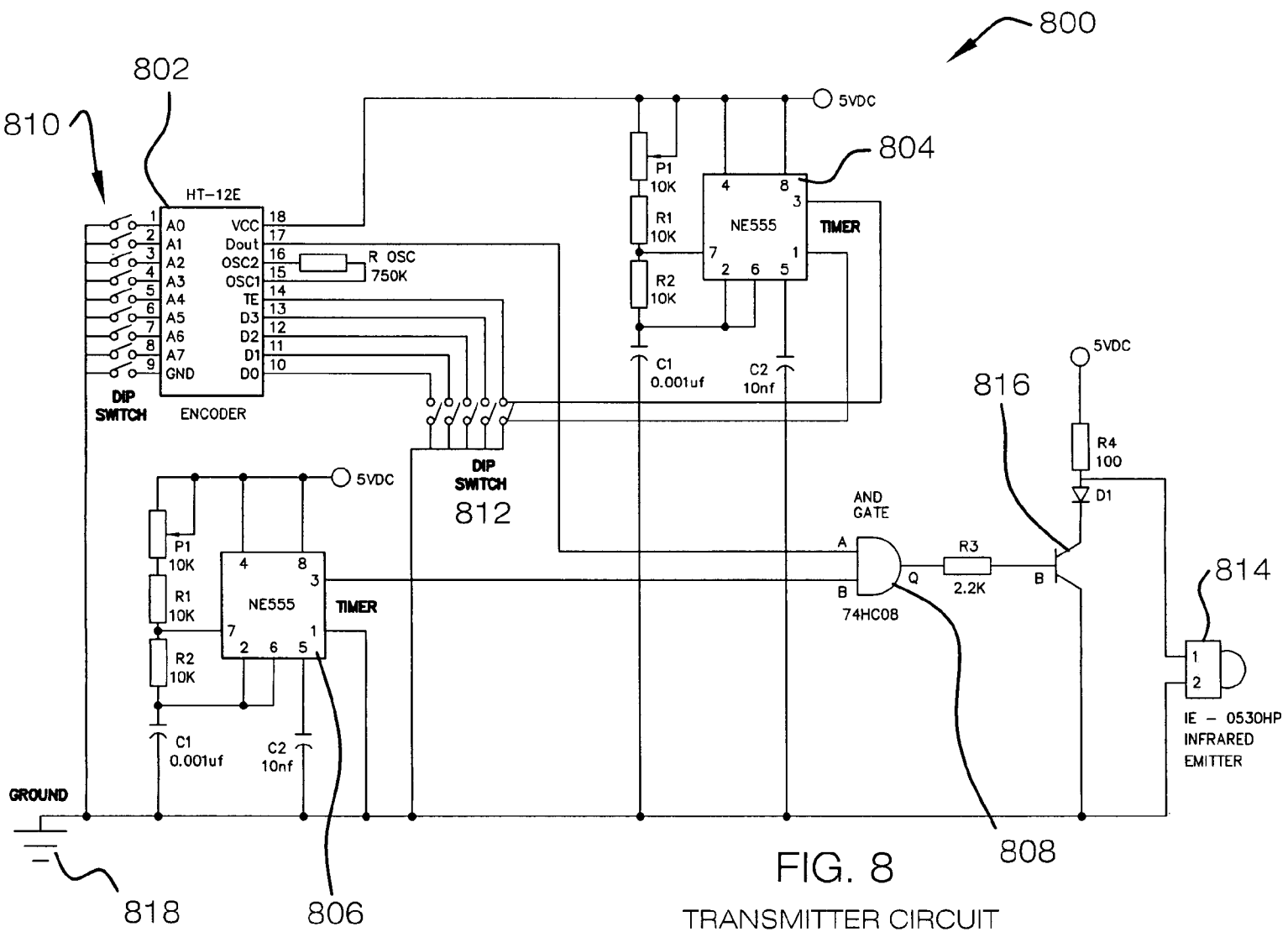
FIG. 8 is a schematic of transmitter circuit 800 for transmitter 102.

FIG. 8 is a schematic of transmitter circuit 800 for transmitter 102. Included with transmitter circuit 800 may be an encoder 802, a first timer 804, a second timer 806, a first AND gate 808, a first dual in-line package (DIP) switch 810, a second DIP switch 812, and an infrared emitter 814. Transmitter 102 additionally may include various discrete electronic components, including an output transistor 816.

Encoder 802 may be configured to change a signal or data into a code, where the code may serve any of a number of purposes such as compressing information for transmission or storage, encrypting or adding redundancies to the input code, or translating from one code to another. In one example, encoder 802 may be a HT-12E radio frequency remote control encoder integrated circuit manufactured by Holtek Semiconductor of Hsinchu Science Park, Taiwan.

The Holtek HT-12E encoder may interface to transmitter modules to create a secure single or multiple channel radio frequency remote control transmitter. Table I below identifies the pin description for the HT-12E encoder, where the pin name in parentheses may be an alternate name for the pin.

TABLE I

Pin Description HT-12E encoder

| PIN NUMBER | PIN NAME | I/O | INTERNAL CONNECTION | DESCRIPTION |
|---|---|---|---|---|
| 1-8 | A0-A7 | I | CMOS IN Pull-High (HT12A/B/C) NMOS TRANSMISSION GATE (HT-12E) | Input pins for address A0-A7 setting. These pins may be externally set to VDD or VSS. |
| 9 | GND (VSS) | I | — | Negative power supply, ground |
| 10-13 | D0-D3 (AD8-AD11) | I | NMOS TRANSMISSION GATE (HT-12E) | Input pins for address/data AD8-AD11 setting. These pins may be externally set to VDD or VSS (only for the HT-12E). |
| 14 | TE | I | CMOS IN Pull-High | Transmission enable, active low |
| 15 | OSC1 (OSC2) | I | OSCILLATOR 1 | Oscillator input pin |
| 16 | OSC2 (OSC1) | O | OSCILLATOR 1 | Oscillator output pin |
| 17 | DOUT | O | CMOS OUT | Encoder data serial transmission output |
| 18 | VCC (VDD) | I | — | Positive power supply |

Encoder 802 may be configured for eight address bits (A0-A7) and four data bits (D0-D3) or encoder 802 may be configured for twelve address bits (A0-A7 plus D0-D3). As in FIG. 8, the oscillator frequency for the internal oscillator of encoder 802 may be set simply with the addition of a resistor between oscillator input pin 15 and oscillator output pin 16. The value of this resistor for transmitter 102 may be approximately 750,000 (750K) ohms, resulting in a carrier frequency of approximately 3.9 kilohertz (kHz) at five voltage direct current (V DC).

First timer 804 and second timer 806 each may be controllers configured to produce accurate timing pulses. In one example, first timer 804 and second timer 806 each may be a NE555 silicone monolithic timing circuit manufactured by Fairchild Semiconductor Corp. of South Portland, Me. Table II below identifies the pin description for the NE555 timer (sometimes called a 555 timer IC).

TABLE II

Pin Description NE555 timer

| PIN NUMBER | PIN NAME | DESCRIPTION |
|---|---|---|
| 1 | GND | Ground: Ground, low level |
| 2 | TR | Trigger: A short pulse high to low on the trigger starts the timer |
| 3 | Q | Output: During a timing interval, the output stays at +VCC |
| 4 | R | Reset: A timing interval may be interrupted by applying a reset pulse to low (0 V) |
| 5 | CV | Control Voltage: allows access to the internal voltage divider (⅔ VCC) |
| 6 | THR | Threshold: The threshold at which the interval ends (it ends if U.thr > ⅔ VCC) |
| 7 | DIS | Discharge: Connected to a capacitor whose discharge time will influence the timing interval |
| 8 | V+, VCC | Vcc: The positive supply voltage which may be between 5 and 15 V, high level |

With its twenty-three transistors, two diodes, and sixteen resistors on a silicon chip installed in an 8-pin mini dual-in-line package (DIP), the NE555 timer may be a highly stable controller capable of producing accurate time delays, or oscillation. In the time delay mode of operation, the time may be precisely controlled by one external resistor and capacitor. For a stable operation as an oscillator, the free running frequency and the duty cycle both may be controlled accurately with two external resistors and one capacitor. The circuit may be triggered and reset on falling waveforms, and the output structure may source or sink up to 200 milliamps (mA).

First AND gate 808 may be a digital logic gate that behaves according to binary logic. A HIGH output results only if both the inputs to First AND gate 808 are HIGH. If neither or only one input to First AND gate 808 is HIGH, a LOW output results. In one example, first AND gate 808 may be a 74HC08 quad 2-input AND gate manufactured by NXP (Philips) Semiconductor of Eindhoven, The Netherlands.

First DIP switch 810 and Second DIP switch 812 each may be an electric switch having toggle switches that permit binary configurations to customize the behavior of transmitter 102 for specific situations.

First DIP switch 810 may be a nine-position (18-pin) DIP switch connected between a ground 818 and address pins 1 through 8 and ground pin 9 of encoder 802. This may permit user 12 to connect any of pins 1-9 directly to ground 818 (FIG. 8).

Second DIP switch 812 may be a five-position (10-pin) DIP switch connected to address/data bit pins 10 through 13 and transmission enable pin 14 of encoder 802. Second DIP switch 812 may permit a user to connect address/data bit pins 10 through 13 to ground 818 and to connect transmission enable pin 14 of encoder 802 to either ground 818 or to the output pin 3 of first timer 804.

Other than the transmission enable pin 14 connection, the settings of first DIP switch 810 and Second DIP switch 812 may provide a unique on-off (binary) address and/or data of encoder 802. These settings may be done in the factory and may be altered by user 12.

Normally, the output pin 3 of first timer 804 may be connected to transmission enable pin 14 of encoder 802, making the associated DIP pin incidental (that is to say, the toggle switch for the associated DIP pin usually will be left open). Transmission by encoder 802 may be enabled whenever an oscillator output of first timer 804 output goes low. Thus, whenever a transmission-enable (low) signal is output from first timer 804 and received by transmission enable pin 14 of encoder 802, encoder 802 may scan the status of its twelve bits of address/data serially in the order A0-A7 and D0-D3 (pins 1-8, 10-13), encode the status data, and then transmit this coded status data away from encoder 802 through output pin 17 of encoder 802.

Output pin 17 of encoder 802 may be connected to a first input of first AND gate 808. Output pin 3 of second timer 806 may be connected to a second input of first AND gate 808. The coded data received by first AND gate 808 from output pin 17 of encoder 802 and the signal received by first AND gate 808 from output pin 3 of second timer 806 may provide the current necessary to drive both of the inputs of first AND gate 808.

Most of the signals within transmitter 102 may be small and not capable of traveling a few inches without being amplified. Output transistor 816 may be a three-terminal semiconductor device that may be used for amplification, switching, voltage stabilization, signal modulation and many other functions. In particular to transmitter circuit 800 of transmitter 802, output transistor 816 may amplify the final output of first AND gate 808 for transmission to receiver 804 (FIGS. 5-8).

To transmit to receiver 804, transmitter 102 may include infrared emitter 814 as an example antenna. Infrared emitter 814 may include a light-emitting diode (LED) to emit infrared radiation. This infrared radiation may be focused by a plastic lens into a narrow beam. The narrow beam may be switched on and off (modulated) to encode the data being transmitted.

In one example, infrared emitter 814 may be infrared emitting diode IE-0530HP manufactured by Waitrony of Tsuen Wan, Hong Kong, where pin 1 is a cathode and pin 2 is an anode. Infrared emitting diode IE-0530HP may be configured to emit over a wide beam angle of plus/minus thirty degrees.

FIG. 9 is a schematic of a receiver circuit 900 for receiver 104. Included with receiver 104 may be an infrared receiver 902, an input transistor 904, a decoder 906, a third DIP switch 908, a biasing transistor 910, a second AND gate 912, a third timer 914, a decade counter 916, NOR gates 918, and an alarm 920. Transmitter 102 additionally may include various discrete electronic components such as resistors, capacitors, diodes and the like.

Infrared receiver 902 may be configured to receive a rapidly pulsing signal created by infrared emitter 814 (FIG. 8) of transmitter 102. In one example, infrared receiver 902 may be infrared receiver module PIC-612S manufactured by Waitrony of Tsuen Wan, Hong Kong, where pin 1 is output, pin 2 is ground, and pin 3 is VCC. Infrared receiver module PIC-612S may be configured to have a sensing distance of 53 feet (16 meters) or less. In one example, infrared receiver module PIC-612S may be configured to have a sensing distance of one of ten feet, three feet, and two feet.

On receiving signals from infrared emitter 814, infrared receiver 902 may filter out any slowly changing infrared radiation from ambient light and then convert the rapidly pulsing infrared radiation to an electric current. Since infrared radiation does not penetrate walls and the power to infrared emitter 814 may be adjusted to prevent infrared radiation of infrared emitter 814 from penetrate clothing, the signal between transmitter 102 and receiver 104 may be broken were cell phone 400 to be taken out of the line-of-sight of user 10 (such as a thief putting cell phone 400 in a pocket), even if the distance between transmitter 102 and receiver 104 is less than two feet.

Figure 10:
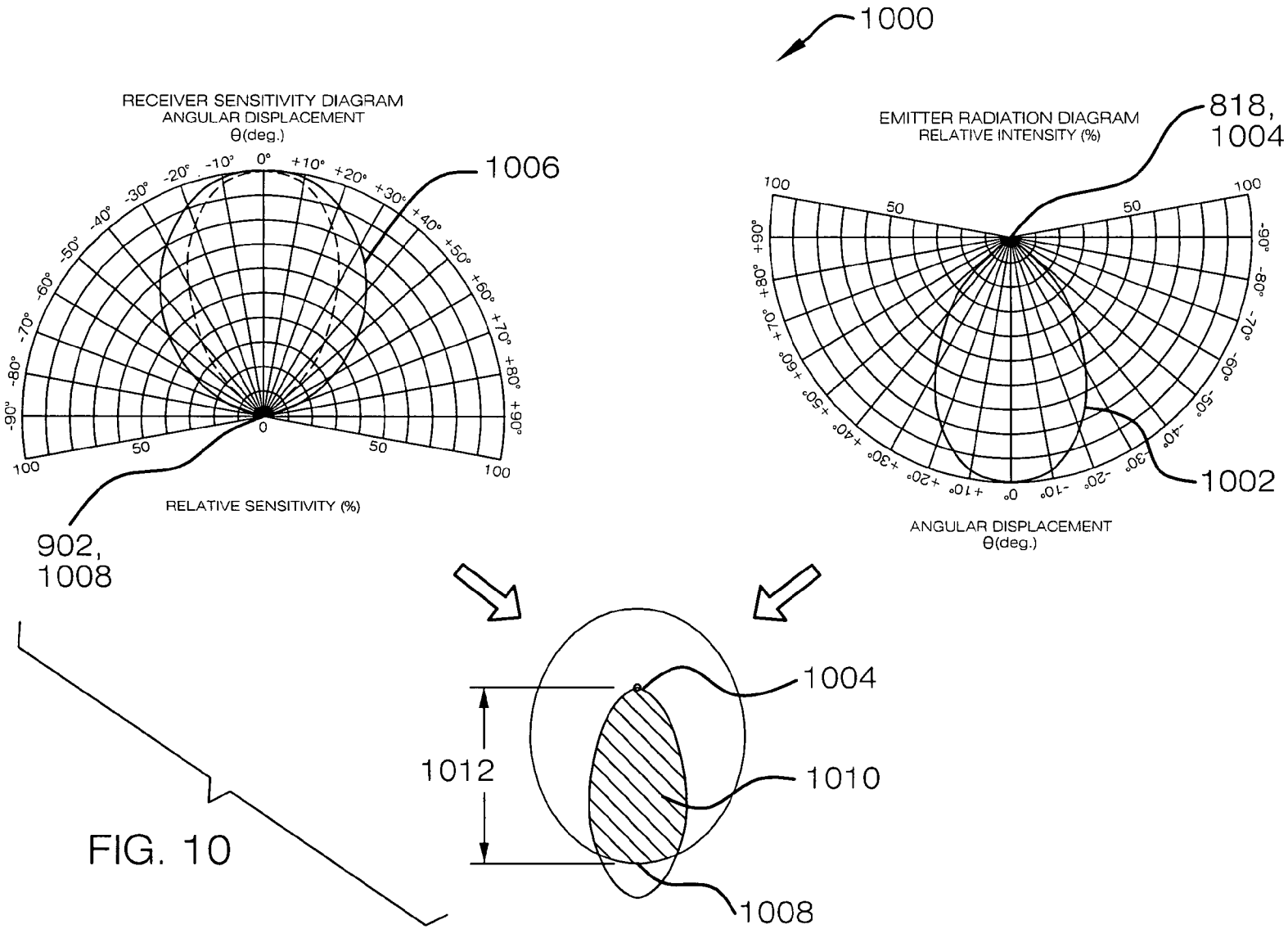
FIG. 10 includes displacement diagrams 1000 for infrared emitter 814 and infrared receiver 902.

FIG. 10 includes displacement diagrams 1000 for infrared emitter 814 and infrared receiver 902. Radiation emitted from infrared emitter 814 may not be omni directional but rather emanate outward from infrared emitter 814 in a pattern resembling an emitter lobe 1002. With infrared emitter 814 positioned at a null location identified in FIG. 10, infrared emitter 814 may emit infrared radiation as a roundish projection originating at an emitter null location point 104.

Radiation received by infrared receiver 902 may not be omni directional but rather may arrive to infrared receiver 902 from a location within a pattern resembling a receiver lobe 1006. With infrared receiver 902 positioned at a null location identified in FIG. 10, infrared receiver 902 may receive infrared radiation from anywhere within a roundish projection terminating in a receiver null location point 1008.

As noted above, an alarm may sound when transmitter 102 and receiver 104 are separated by more than a predetermined distance (such as two, three, or ten feet). A problem with a circular protected area is that the protected item (here cell phone 400) may be within the circular protected area but out of the line of site or line of perception of user 12. In that case, a thief could take advantage of the situation to steal the protected item.

With infrared emitters and receivers, a protected area 1010 need not be a circle having a radius such as ten feet. Rather, protected area 1010 may be that area within which emitter lobe 1002 and receiver lobe 1006 may overlap so long as emitter lobe 1002 overlaps infrared receiver 902. Protected area 1010 may be configured to have a maximum distance 1012, where maximum distance 1012 may be one of two feet, three feet, and ten feet.

Signals received by infrared receiver 902 (FIG. 9) from infrared emitter 814 may be weak and in need of a power boost. With VCC pin 3 of infrared receiver 902 connected to a five-voltage direct current power supply and ground pin 2 connected to a ground 922, receiver output pin may be connected to input transistor 904. Input transistor 904 may be a three-terminal semiconductor device that may be used for amplification, switching, voltage stabilization, signal modulation and many other functions. In particular to receiver circuit 900 of receiver 104, input transistor 904 may amplify the electric signal from infrared receiver 902 for transmission to decoder 906.

As noted above, decoder 906 may be included with receiver 104. Decoder 906 may be a device that does the reverse of encoder 802 (FIG. 8), namely, undoing the encoding so that the original information may be retrieved. In one example, decoder 906 may be a HT-12D $2^{12}$ radio frequency remote control decoder integrated circuit chip manufactured by Holtek Semiconductor of Hsinchu Science Park, Taiwan.

The Holtek HT-12D decoder may be paired with the Holtek HT-12E encoder to maintain a secure single or multiple channel radio frequency remote control transmitter-receiver combination. Table III below identifies the pin description for the HT-12D decoder, where the pin name in parentheses may be an alternate name for the pin.

TABLE III

Pin Description HT-12D decoder

| PIN NUMBER | PIN NAME | I/O | INTERNAL CONNECTION | DESCRIPTION |
|---|---|---|---|---|
| 1-8 | A0-A7 | I | NMOS Transmission Gate | Input pins for address A0-A7 setting. These pins may be externally set to VSS or left open. |
| 9 | GND (VSS) | — | — | Negative power supply, ground |
| 10-13 | D0-D3 (D8-D11) | O | CMOS OUT | Output data pins, power-on state is low. |
| 14 | Din (DIN) | I | CMOS IN | Serial data input pin |
| 15 | OSC1 (OSC2) | I | OSCILLATOR | Oscillator input pin |
| 16 | OSC2 (OSC1) | O | OSCILLATOR | Oscillator output pin |
| 17 | V1 (VT) | O | CMOS OUT | Valid transmission, active high |
| 18 | VCC (VDD) | — | — | Positive power supply |

Similar to encoder 802 (FIG. 8), third DIP switch 908 may be a nine-position (18-pin) DIP switch connected between ground 922 and address input pins 1-8 and ground pin 9 of decoder 906 in receiver circuit 900. An output of input transistor 904 may be connected to serial data input pin 14 of decoder 906. For the transmission from transmitter 102 to receiver 104 to be successful, the address contained within the signal from transmitter 102 and the address of receiver 1204 may have to match. This generally may prevent receiver 104 from being lulled into complacency by receiving a signal from someone else's proximity alarm system transmitter.

After processing a received signal, decoder 908 may send out a valid transmission signal through out pin 17 of decoder 908. As long as decoder 908 is receiving a valid signal from input transistor 904, the output of the decoder at pin 17 (V1) may remain high. This output signal from pin 17 of decoder 908 may be fed to a base of biasing transistor 910. A collector of biasing transistor 910 may be connected to a first input of second AND gate 912.

Biasing transistor 910 may be a three-terminal semiconductor device that may be used for amplification, switching, voltage stabilization, signal modulation and many other functions. In particular to receiver circuit 900 of receiver 104, biasing transistor 910 may be biased on when the output signal from pin 17 of decoder 908 indicates a valid signal (output high). When biased on, high current may pass through biasing transistor 910. This, in turn, may keep the voltage low at the collector of biasing transistor 910 to maintain a low voltage at the first input to second AND gate 912.

Second AND gate 912 may operate similar to first AND gate 808 of transmitter circuit 800 (FIG. 8). Second AND gate 912 may be a digital logic gate that behaves according to binary logic. A HIGH output results only if both the inputs to second AND gate 912 are HIGH. If neither or only one input to second AND gate 912 is HIGH, a LOW output results. In one example, second AND gate 912 may be a 74HC08 quad 2-input AND gate manufactured by NXP (Philips) Semiconductor of Eindhoven, The Netherlands.

A second input of second AND gate 912 may be connected to output pin 3 of third timer 914. Third timer 914 may be a controller configured to produce accurate timing pulses. In one example, third timer 914 may be a NE555 silicone monolithic timing circuit manufactured by Fairchild Semiconductor Corp. of South Portland, Me. Table II above identifies the pin description for the NE555 timer.

A counter may be a device that may store (and sometimes display) the number of times a particular event or process has occurred, often in relationship to a clock signal. An output of second AND gate 912 may be connected to a RESET pin 15 of decade counter 916. Rather than having a binary representation, decade counter 916 may count in tens utilizing a scanning type of behavior. In one example, decade counter 916 may be a CMOS 4017 decade counter manufactured by a variety of companies. Table IV below identifies the pin description for the CMOS 4017 decade counter, where the pin name in parentheses may be an alternate name for the pin.

TABLE IV

CMOS 4017 decade counter

| PIN NUMBER | PIN NAME/DESCRIPTION |
|---|---|
| 1 | Output 5 |
| 2 | Output 1 |
| 3 | Output 0 |
| 4 | Output 2 |
| 5 | Output 6 |
| 6 | Output 7 |
| 7 | Output 3 |
| 8 | VSS 0 V |
| 9 | Output 8 |
| 10 | Output 4 |
| 11 | Output 9 |
| 12 | ÷ 10 output |
| 13 | ENABLE input (CP1) |
| 14 | CLOCK input (CPO) |
| 15 | RESET input (MR) |
| 16 | VDD +3-15 V |

The HT-12D may include ten separate outputs that may go HIGH in sequence. Just one of the individual outputs may be HIGH at a time. Because of the ÷10 output operation, ÷10 output pin 12 may be HIGH for counts 0-4 and LOW for counts 5-9.

CLOCK input pin 14 of decade counter 916 may be tied to a high voltage output pin 4 of NOR gates 918. NOR gates 918 may be digital logic gates that behave as follows. A HIGH output results if both the inputs to the gate are LOW. If one or both input is HIGH, a LOW output results.

In one example, NOR gates 918 may be a CMOS 4001 quad 2-input NOR gate manufactured by a variety of companies. Table V below identifies the pin description for the CMOS 4001 NOR gate, where the pin name in parentheses may be an alternate name for the pin.

TABLE V

Pin Description CMOS 4001 NOR gates

| PIN NUMBER | PIN NAME/DESCRIPTION |
|---|---|
| 1 | Input A1 |
| 2 | Input B1 |
| 3 | Output Q1 |
| 4 | Output Q2 |
| 5 | Input B2 |
| 6 | Input A2 |
| 7 | Vss |
| 8 | Input A3 |
| 9 | Input B3 |
| 10 | Output Q3 |
| 11 | Output Q4 |
| 12 | Input B4 |
| 13 | Input A4 |
| 14 | Vdd |

NOR gates 918 may include four NOR gates—NOR gate 1, NOR gate 2, NOR gate 3, and NOR gate 4—and may be interconnected as follows. Input A1 pin 1 may be connected to 5-VDC to provide a constant high first input. Input B1 pin 2 may be connected to output Q2 pin 4 of NOR gate 2. The circular logic of the interconnection may maintain a high second input to input B1 pin 2, thus causing the output of NOR gate 1 of NOR gates 918 to be low. Output Q1 pin 3 is ported into both the first (pin 5) and second (pin 6) input of NOR gate 2. With two low outputs going into NOR gate 2, output Q2 pin 4 of NOR gate 2 will be high. In this way, CLOCK input pin 14 of decade counter 916 may be tied to high voltage output Q2 pin 4 of NOR gates 918.

Recall that receiver 104 may include alarm 920. Alarm 920 may be a device that serves to call attention to or to warn of something. Alarm 920 may be configured to vibrate, emanate a sound, emanate a flashing neon light, or perform any combination thereof. Output 8 pin 9 of decade counter 916 may be directly connected to alarm 920.

Recall that second input of second AND gate 912 may be connected to output pin 3 of third timer 914. Timing pulses emitted by third timer 914 may cause the second input of second AND gate 912 to fluctuate between high and low. However, with the first input to second AND gate 912 held steadily low by a valid signal received from transmitter 102, the output of second AND gate 912 will be low, regardless of any 0-bit or 1-bit fluctuations in the second input of second AND gate 912.

Receiver 104 may stop receiving valid signals from transmitter 102 where transmitter 102 and receiver 104 are separated by a predetermined distance or where something may be blocking or interfering with the signal from transmitter 102. When receiver 104 stops receiving a valid signal from transmitter 102, the output signal from pin 17 of decoder 908 may go low, putting a low voltage onto the base of biasing transistor 910, which reduces the current flow through biasing transistor 910 to cause the collector voltage of biasing transistor 910 to be high. With the collector of biasing transistor 910 connected directly to the first input of second AND gate 912, the first input to second AND gate 912 may be set high.

Before, with the first input to second AND gate 912 low, the fluctuations of the second input had no effect on the collector voltage of second AND gate 912. Now, with the first input set high, the output of second AND gate 912 may fluctuate between high and low along with the timing voltage on the second input of second AND gate 912. With the collector of second AND gate 912 connected to RESET pin 15 of decade counter 916 and with CLOCK input pin 14 tied to the high voltage output of NOR gates 918, this now fluctuating output may cause the count in decade counter 916 to advance with each fluctuation. This may cause regular fluctuations in all output pins of decade counter 916, including output 8 pin 9 of decade counter 916. With output 8 pin 9 of decade counter 916 connected to alarm 920, alarm 920 may sound/vibrate/shine continuously until transmitter 102 comes back into range.

In view of the above, proximity alarm system 100 may be a device having condition responsive indicators. For example, receiver 104 may be responsive to a state of cell phone 400 (FIG. 1) being put in or taken away from protected area 1010 (FIG. 10). Moreover, alarm 920 may be automatically operated to produce a humanly perceptible signal in response to proximity alarm system 100 attaining a predetermined condition, such as exceeding a certain distance between receiver 104 and transmitter 102 or a signal between the two being interfered with.

Utilizing infrared radiation signals in proximity alarm system 100 provides some advantages. Utilizing radio frequency signals in proximity alarm system 100 provides some advantages as well. The next description addresses these advantages.

Figure 11:
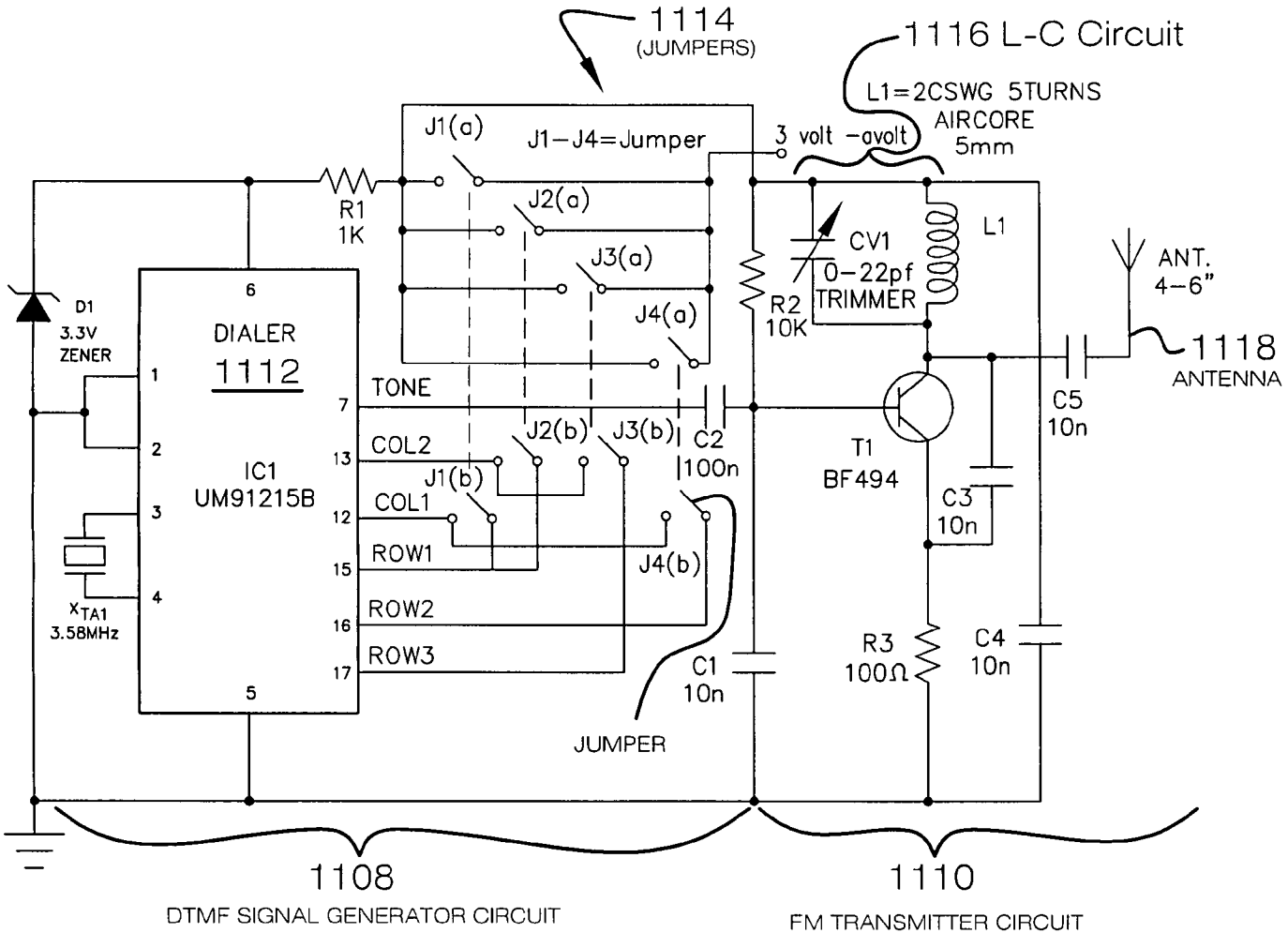
FIG. 11 is a schematic of a transmitter circuit 1106 for a transmitter circuit 1102 and a receiver 1104 of a proximity alarm system 1100.

FIG. 11 is a schematic of a transmitter circuit 1106 for a transmitter 1102 and a receiver 1104 of a proximity alarm system 1100. Transmitter circuit 1106 may be configured to employ radio frequency signals to transmit control signals and control various outputs. By controlling the power to transmitter circuit 1106, the distance traveled by the control signals may be controlled to be within a desired range, such as two feet to twenty feet.

Transmitter circuit 1102/receiver 1104 of proximity alarm system 1100 may have handheld structure similar to transmitter 102/receiver 104 of proximity alarm system 100 but be modified for radio frequency circuitry. By reducing transmitter circuit 1102 to a micro size and configuring transmitter circuit 1102 to employ a voltage of 2.5 to 3.0 volts, transmitter circuit 1102 may be installed and fit properly within cell phone 400 and utilize the power supplied by cell phone 400.

Observations have demonstrated that user 12 may have up to four electronic devices on their person: a laptop 200 (FIG. 2), a personal digital assistant 300 (FIG. 3), and two cell phones 400 (FIG. 4), for example, or four cell phones 400, for example. On business or pleasure trips, many users additionally may carry on their person a digital camera to record visual memories, an iPod to listen to personally chosen music, a wallet, keys, and bring other valuable or easily lost items such as children. User 12 would find it very beneficial to keep track of all these items automatically with one receiver.

Receiver 1104 may be configured to receive and differentiated between up to twelve signals, each of which may be sent by a different transmitter circuit 1102 attached to an article. By arrangement of jumpers or switches, transmitter circuit 1102 may be configured to send out one twelve different signals receivable by the same receiver 1104. In this example, receiver 1104 proximity alarm system 1100 may include four receiver channels and each transmitter circuit 1102 may be configured to transmit one of four signals that may be accepted and differentiated by one of the four receiver channels within receiver 1104. However, the number of receiver channels may be extended to twelve.

Transmitter circuit 1102 may be a remote control transmitter. Included with transmitter circuit 1106 may be a dual-tone multi frequency (DTMF) signal generator circuit 1108 and a frequency modulated (FM) transmitter circuit 1110.

DTMF signal generator circuit 1108 may generate tones as control codes that may be used for frequency modulation of a carrier wave signal. At receiver 1104, these frequency-modulated signals may be intercepted to obtain DTMF tones at speaker terminals. DTMF signal generator circuit 1108 may include a dialer 1112 and jumpers 1114.

Dialer 1112 may be an electronic device to call pre-selected numbers automatically when activated. Dialer 1112 may be a dialer integrated circuit configured to be attached to or otherwise utilize in telephone instruments such as cell phone 400. In one example, dialer 1112 may be a dedicated UM91215B Tone/Pulse Dialer manufactured by United Microelectronics Corporation (UMC) of Hsin-Chu City, Taiwan. The UM91215B dialer is for the American and European telephone systems and the UM91214B dialer is for the Nigerian and Japanese telephone systems, a difference being in the floating MODE IN pin 2 dial rate and VDD MODE IN pin 2 M/B ratio.

The UM91215B dialer provides dialing pulse (DP) or dual tone multi-frequency (DTMF) dialing of 32-digit dialing numbers. The up to 32-digit dialing numbers may be entered in the UM91215B dialer with a 4×4 (or 2×8) matrix keyboard and saved for redialing. Table VI below identifies the pin description for the UM91215B dialer, where the pin name in parentheses may be an alternate name for the pin.

include four jumper blocks J1(*a*)/J1(*b*), J2(*a*)/J2(*b*), J3(*a*)/J3(*b*), and J4(*a*)/J4(*b*). For example, when jumper block J1(*a*)/J1(*b*) shorts C1 column pin 12 to R1 row pin 15, DTMF tones corresponding to the digit 1 may be output from TONE pin 7. Similarly, C1 column pin 13, R1 row pin 16, and R3 row pin 17 may be utilized to dial digits 2, 4 and 8.

Since four DTMF tone pairs may be desired, an individual transmitter circuit 1102 may make utilization of two jumper blocks such as J1 and J2. Thus, where proximity alarm system 100 may be used to monitor four different devices, each transmitter circuit 1102 installed into an electronic device such as cell phone 400 may utilize the same circuit diagram 1106 but different channel (upper) connections to differentiate each electronic device by receiver 1104.

Jumpers 1114 have the advantage that they usually only ever need to be set once at a factory and thus are unlikely to be incorrectly set by end users. In an alternate example, jumpers 1114 may be replaced by software-controlled configuration stored in a Non-Volatile Random Access Memory (NVRAM) that may be loaded by a host processor, such as contained within cell phone 400. An advantage of this jumper-less designs may be that it may be fast and easy to set up by a user and adjusted without having physical access to the circuit.

TABLE VI

Pin Description UM91215B dialer

| PIN NUMBER | PIN NAME | I/O | DESCRIPTION |
|---|---|---|---|
| 1 | HK | I | The hook switch inverter input pin detects the state of the hook switch contact. "Off Hook" is represented by a VSS condition and "On Hook" is represented by a VDD condition. |
| 2 | MODE IN | I, Z | The tri-State mode select pin is checked for tone/pulse dialing at each digit key entry. In pulse mode, the dialing rate is checked along with the make/break ratio, at the first key entry. |
| 3 | OSCI | I | Oscillator input pin |
| 4 | OSCO | I | Oscillator output pin |
| 5 | VSS | — | Negative power supply, ground |
| 6 | VDD | — | Positive power supply for 2.0 V to 5.5 V/ |
| 7 | Tone | O | The tone dialing output generates frequencies when a valid DTMF mode key press is detected |
| 8 | XMITMUTE | O | The dialing transmission mute output is "ON" during DTMF dialing. |
| 9 | MODE OUT | O | The mode output pin is "ON during tone output and "OFF" during pulse output. |
| 10 | KT | O | The key-in tone output sends out a "beep" tone for each pulse mode key entry. |
| 11 | DP | O | The dialing pulse output is "ON" during break and "OFF" during make in pulse dialing mode. |
| 12-14 | C1-C3 | — | Keyboard pins C1-C3 may be the column interface to an XY matrix keyboard. |
| 15-18 | R1-R4 | — | Keyboard pins R1-R4 may be the row interface to an XY matrix keyboard |

To provide the approximately three volts for operation of dialer 1112, a zener diode voltage regulator D1 may be attached to both a hook switch inverter input pin 1 and a tri-state mode select pin 2 to convert nine volts into three volts for utilization by dialer 1112. Pins 1 and 2 may be utilized as chip select and DTMF mode select pins respectively. A timing base may be provided by attaching a quartz crystal of 3.58 MHz between oscillator input pin 3 and oscillator output pin 4.

In general, shorting or making contact between one row pin (R1-R4 pins 15-18) and one column pin (C1-C3 pins 12-14) may generate a unique tone output at TONE pin 7 that may correspond to a particular digit, such as digits 0-9, and phone symbols such as # or *. With the input from the fourth column of a 4×4 matrix keyboard connected to ground, ground may be combined with one column pin (C1-C3 pins 12-14) two flash keys with different break times, a pause, or redial.

Jumpers 1114 may assist in shorting or making contact between one row pin and one column pin. Jumpers 1114 may be any short length conductor configured to close a break in or bypass part of an electrical circuit. To generate four unique tones to monitor four different articles, jumpers 1114 may The output from TONE pin 7 of dialer 1112 may be provided as an input to FM transmitter circuit 1110. FM transmitter circuit 1110 may frequency modulate the carrier and transmit the signal into the air. In addition to generating the specific tone pairs when connected, jumpers 1114 simultaneously may provide power to transmitter circuit 1106. Included with FM transmitter circuit 1110 may be an indictor-capacitor circuit 1116 and a transmitter antenna 1118.

Inductor-capacitor circuit 1116 may include a coil LI and trimmer capacitor VC1. The carrier frequency may be determined by coil LI and trimmer capacitor VC1, which may be adjusted for around 100 MHz operations. Transmitter antenna 1118 may transmit radio waves to receiver 1104 and may be two to eight centimeters (cms) in length to provide the desired transmittal range.

Figure 12:
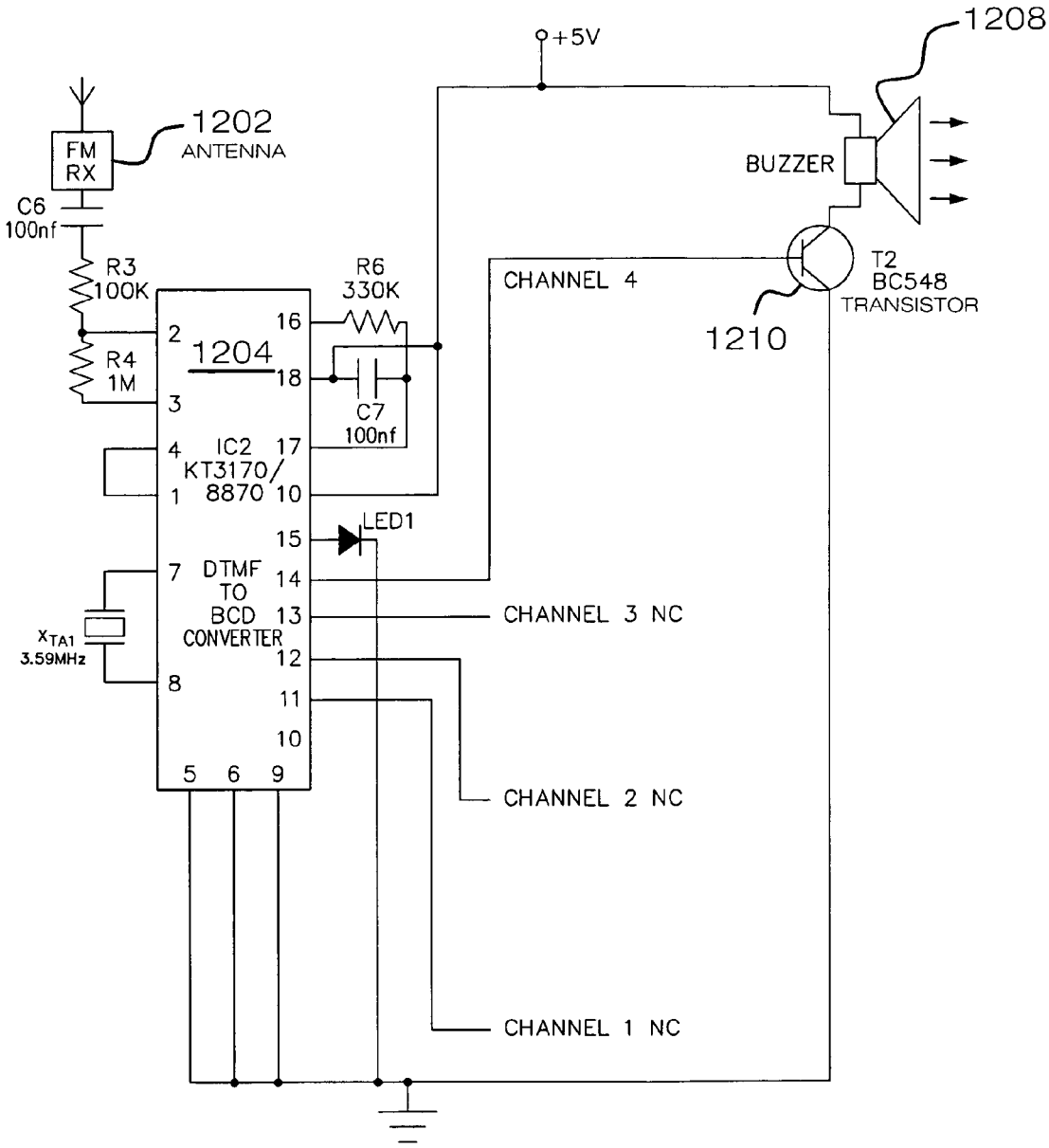
FIG. 12 is a schematic of a receiver circuit 1200 for transmitter circuit 1102 and receiver 1104 of proximity alarm system 1100.

FIG. 12 is a schematic of a receiver circuit 1200 for receiver 1104 of proximity alarm system 1100. Receiver circuit 1200 may be configured to receive control signals from transmitter circuit 1102. Included with receiver circuit 1200 may be a receiving antenna 1202, a receiver chip 1204, alarms 1206, including alarm 1208, and an amplifier transistor 1210. Frequency modulated DTMF signals received by receiving antenna 1202 may be sent to receiver chip 1204.

Receiver chip 1204 may convert received dual-tone multi frequency (DTMF) to binary coded decimal (BCD), where the BCD output may be used to switch-on and switched-off alarm 1206. In one example, DTMF-to-BCD converter 1204 may be a dedicated KT3170 low power DTMF receiver chip manufactured by Samsung Electronics America, Inc. (SEA) of Ridgefield Park, N.J.

The KT3170 receiver chip may be configured to receive tones, decodes all sixteen DTMF tone pairs into a 4-bits digital code (DTMF-to-BCD), and verify the frequency and duration of the received tones before passing the corresponding code to an output bus. Table VII below identifies the pin description for the KT3170 receiver chip, where the pin name in parentheses may be an alternate name for the pin.

TABLE VII

Pin Description KT3170 receiver chip

| Pin No | Symbol | Description |
|---|---|---|
| 1 | IN+ | Non inverting input of the op amp. |
| 2 | IN− | Inverting input of the op amp. |
| 3 | GS | Gain Select. The output used for gain adjustment of analog input signal with a feedback resistor. |
| 4 | Vref | Reference Voltage output (VDD/2, Typ) may be used to bias the op amp input of VDD/2. |
| 5 | Iin | Input inhibit. High input states inhibits the detection of tones. This pin may be pulled down internally. |
| 6 | PDN | Control input for the stand-by power down mode. Power down may occur when the signal on this input may be in high states. This pin may be pulled down internally. |
| 7, 8 | OSC1, OSC2 | Clock input/output. |
| 9 | GND | Ground pin. |
| 10 | OE | Output Enable input. Outputs Q1-Q4 may be CMOS push pull when OE is High and open circuited (High impedance) when disabled by pulling OE low. Internal pull up resistor built in. |
| 11-14 | Q1-Q4 | Three state data output. When enabled by OE, these digital outputs provide the hexadecimal code corresponding to the last valid tone pair received. |
| 15 | DSO | Delayed Steering Output. Indicates that valid frequencies have been present for the required guard time, thus constituting a valid signal. Presents a logic high when a received tone pair has been registered and the output latch may be updated. Returns to logic low when the voltage on SI/GTO falls below VTH. |
| 16 | ESO | Early Steering Outputs. Indicates detection of valid tone output a logic high immediately when the digital algorithm detects a recognizable tone pair. Any momentary loss of signal condition will cause ESO to return to low. |
| 17 | SI/GTO | Steering Input/Guard Time Output. A voltage greater the VTS detected at SI causes the device to register the detected tone pair and update the output latch. A voltage less than VTS frees the device to accept a new tone pair. The GTO output acts to reset the external steering time constant, and its state may be a function of ESO and the voltage on SI |
| 18 | Vdd | Power Supply (+5 V, Typ) |

To engage an internal oscillator for timing purposes, a 3.579545 MHz crystal may be connected between OSC1 clock input pin 7 and OSC2 clock output pin 8 of receiver chip 1204. The tone input may be connected to IN-inverting input pin 2. When fed with DTMF tones, receiver chip 1204 may produce a corresponding BCD output. For example, when digit 1 may be received by receiver 1104 from transmitter circuit 1102, a binary output of receiver chip 1204 may be 0001 and when digit 4 is received, a binary output may be 0100.

The BCD outputs of receiver chip 1204 may be taken from Q1-Q4 data output pins 11 to 14, respectively. These outputs may be fed to four individual alarms 1206. For example, the output of QQ4 data output pin 14 may be connected to alarm 1208 through amplifier transistor 1210. Amplifier transistor 1210 may be a BC548 NPN silicon transistor manufactured by Motorola of Schaumburg, Ill. Since dialer 1112 of FIG. 11 may generate up to twelve DTMF tones (0-9, *, and #), receiver circuit 1200 may be configured to control as many as twelve channels and twelve alarms 1206.

Whenever a digit may be received by receiver chip 1204, receiver chip 1204 may decode the digit and assign a clock pulse to the decoded digit. This clock pulse may be used to toggle amplifier transistor 1210. In turn, amplifier transistor 1210 may toggle alarm 1208.

In a situation where user 12 may be monitoring two different electronic devices, each of the two electronic devices may include a transmitter circuit 1102, where each transmitter may have different channel connections and different frequencies. For example, junctions J1, J2 of FIG. 11 may correspond to channel 1, channel 2 of FIG. 12. Receiver 1104 may contain two of these receivers with corresponding two channels: connections channel 1, channel 2. However, these receivers may be matched together to be one and simultaneously to receive different control signals from a first transmitter circuit 1102 and a second transmitter 110. Thus, receiver 1104 may contain two different alarms with two different effects (sound, vibrate, light), to permit user 14 to differentiate the electronic device that may be missing or stolen.

Figure 13:
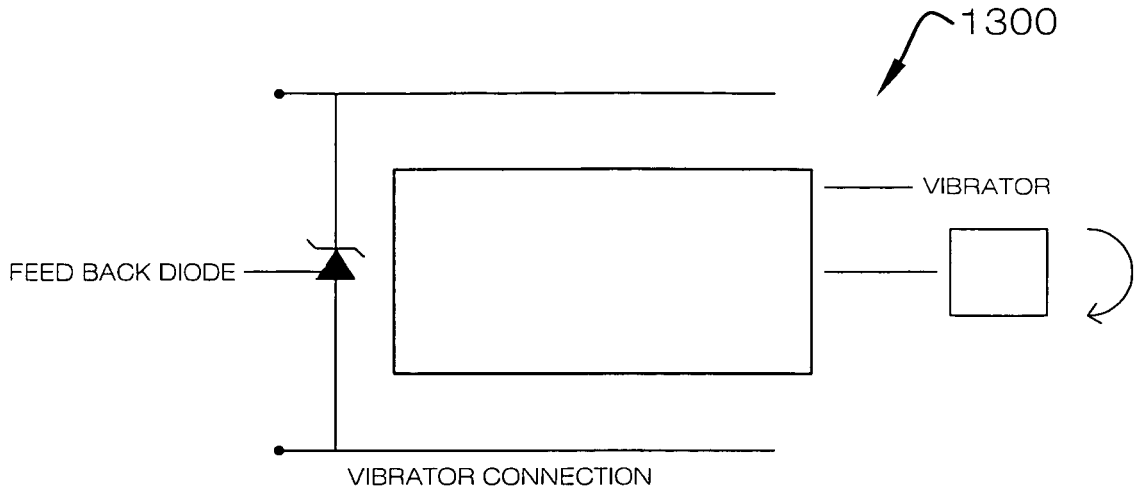
FIG. 13 is a block diagram of a vibrator circuit 1300 that may be added to receiver circuit 1200 of FIG. 12.
Figure 14:
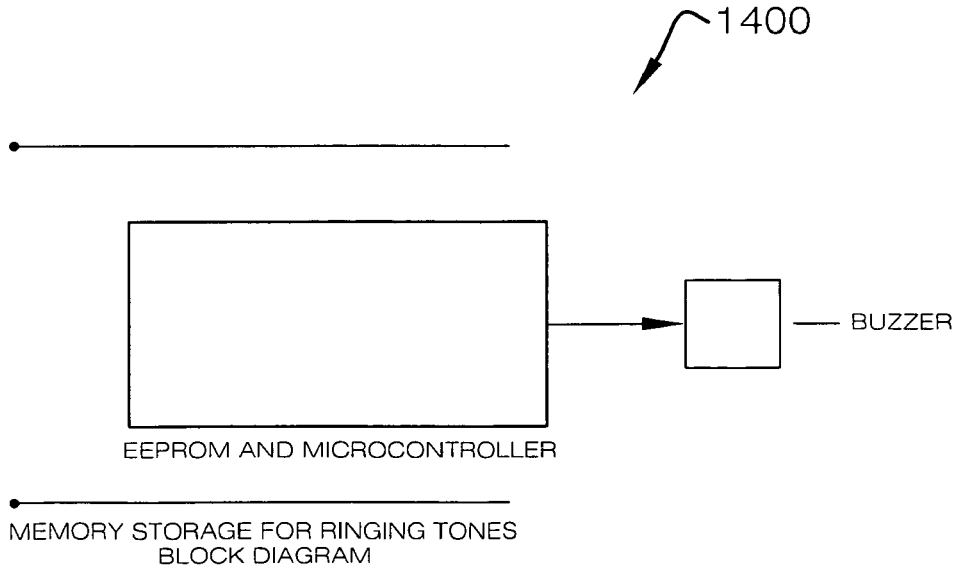
FIG. 14 is a block diagram of a ring tone schematic 1400 that may be added to receiver circuit 1200 of FIG. 12.

FIG. 13 is a block diagram of a vibrator circuit 1300 that may be added to receiver circuit 1200 of FIG. 12. FIG. 14 is a block diagram of a ring tone schematic 1400 that may be added to receiver circuit 1200 of FIG. 12.

Figure 15:
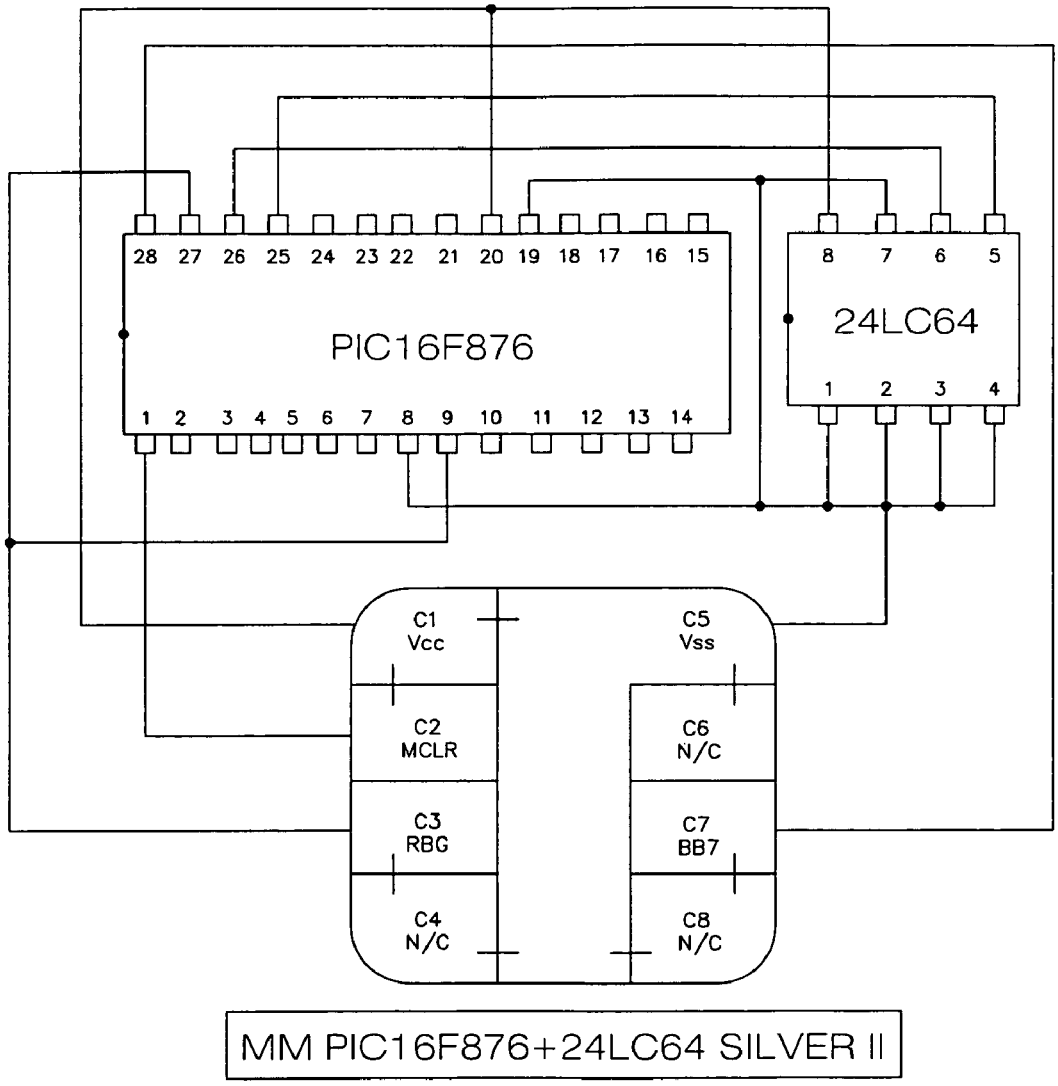
FIG. 15 is a subscriber identity module (SIM) backup schematic 1500 for receiver 104 and receiver 1104 using Silver Wafer Card layout.

FIG. 15 is a subscriber identity module (SIM) backup schematic 1500 for receiver 104 and receiver 1104 using Silver Wafer Card layout. It may be necessary to consider the programmer GSMTE-21 and the PICPROG1 programmer to make SIM Card backups using the new dejan program GSM a36 Gold & Silver Wafer card. The PIC16F877 microcontroller and PIC16F876 microcontroller essentially may be the same chip, but there is more programming area on the PIC16F877. The 24LC64 erasable programmable read-only memory (E-PROM) chip may be a 64 Kbit electrically erasable PROM organized as a single block of 8K×8-bit memory with a 2-wire serial interface.

Figure 16:
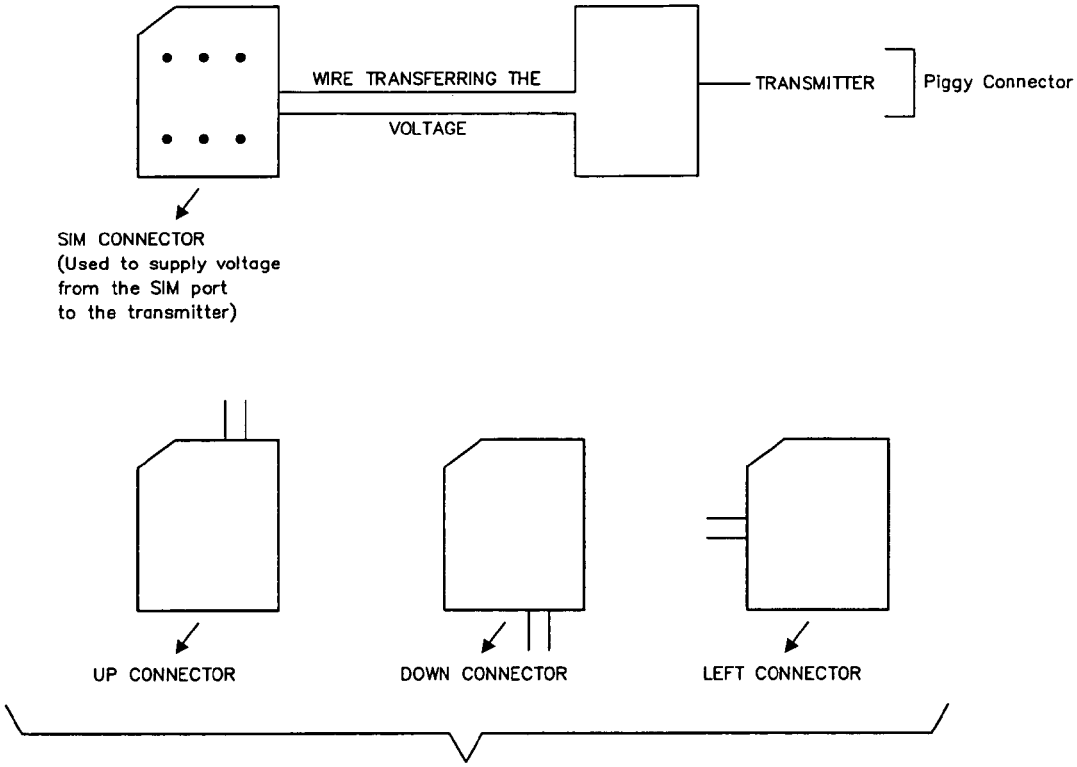
FIG. 16 is block diagram of a SIM connector 1600.

FIG. 16 is block diagram of a SIM connector 1600. SIM connector 1600 may be connected with the SIM and may be slotted on the SIM port to draw the voltage needed to drive transmitter 102 and transmitter circuit 1102. SIM connector

1600 may come in various forms, each based on the model and SIM slot of cell phone 400. Whenever cell phone 400 is switched off or cannot read the SIM, the SIM voltage will not be supplied. Thus, transmitter 102 will be off whenever cell phone 400 is switched off or cannot read the SIM. This, in turn, automatically will trigger an alarm in receiver 104 and receiver 1104.

Figure 17:
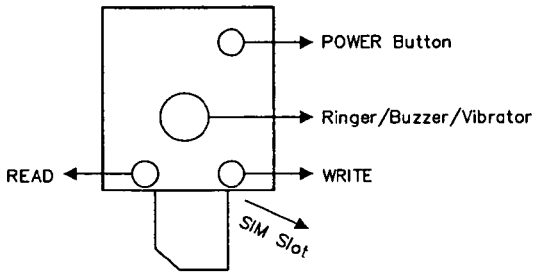
FIG. 17 and FIG. 18 are alternate examples of structures for proximity alarm system 100.
Figure 18:
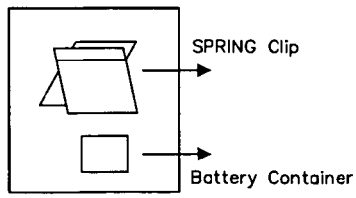

FIG. 17 and FIG. 18 are alternate examples of structures for proximity alarm system 100.

The proximity alarm system may be an electronic safety device that may help prevent theft. Theft prevention may function exactly the same way as accidental loss prevention. If somebody tried to walk off with a possession of the user protected by the proximity alarm system, an alarm may immediately alert the user. This may provide him or her with the opportunity to take appropriate action according to the situation. In addition, this may include notifying nearby security personnel, calling 911, bringing attention of the theft to all of the people in the vicinity, etc. In many cases, the thief may no doubt abandon the conspicuous item sounding an ear piercing alarm to try to make it easier to avoid apprehension especially if the user started to shout "Thief!"

The proximity alarm system may fulfill the need for a transmitter worn by the user connected by RF signal to a receiver attached to an item to be protected from loss, set up so that an alarm may sound when the two devices are separated by more than 10 feet. Appealing features of the proximity alarm system may include protection of property, worry reduction, and portability. Modern life is fast-paced and confusing, and it is easy to lose or misplace items of value. The pair of devices of the proximity alarm system may help prevent a cell phone, laptop, PDA, iPod, or another item from being left behind.

Before going out for the evening, the user may simply clip the proximity alarm system transmitter to his or her belt and attach the receiver to the cell phone or other item to be protected. Throughout the evening, as long as the object attached to a receiver was within 10 feet, no alarm may sound. However, if, for example, the user got up and started to walk away from a cafe leaving the cell phone on the table, the receiver alarm may sound. This may alert the user to go back and retrieve the cell phone, thus preventing its loss.

The proximity alarm system may help prevent the costly process of replacement of cell phones, laptops, PDAs, etc. In addition, the loss of vital data may be prevented. In some cases, as with a laptop containing confidential corporate information, the loss of the data could be much more costly than the loss of the device itself. This compact, easy-to-use wireless set may make it easier to enjoy an evening out without worrying about forgetting valuable things and leaving them behind.

The proximity alarm system may be an electronic safety device that may function with a transmitting and receiving circuitry. It may be configured to protect, secure and safeguard from theft and or loss of handheld ICT equipments including but not limited to mobile phones, i-pods, palmtops, laptops, electronic diaries, digital cameras, antique pieces, artworks, priceless jewelry, small but costly household equipment, pets, etc. The proximity alarm system may be adapted to keep young toddlers within reach of their minders.

The proximity alarm system may give off an ear piercing alarm that alerts the owner of an impending loss of the equipment as soon as the reception of signals may be broken or interrupted between the transmitting and receiving sides when a distance of about 10 feet has been exceeded. The proximity alarm system may operate as a couple kit. One side may be worn on the person of the owner while the receiver may be attached to the equipment e.g. a mobile phone, as a phone accessory/pouch. The couples may track each other and maintain harmony within 10 feet approximate radius beyond which an alarm sets off alerting the wearer/owner of impending loss. It may be safe to utilize and may be of a lightweight.

The proximity alarm system may be an electronic safety device that functions with a transmitting and receiving circuitry. Configured to monitor, protect, secure and safeguard from theft and or loss of handheld ICT equipments, the proximity alarm system may be utilized to protect mobile phones, i-pods, palmtops, laptops, electronic diaries, digital cameras, antique pieces, artworks, priceless jewelry, small but costly household equipment, and pets.

In one example, the proximity alarm system may give off a near piercing alarm that alerts the owner of an impending loss of the equipment as soon as the reception of signals may be broken or interrupted between the transmitting and receiving sides when a distance of about 2-10 feet has been exceeded. Many users carry multiple handsets, each of which may require protection. These multiple handsets may need to be able monitor their phones while at occasions/events/parties. The vibration and neon light features in the proximity alarm system may permit users to monitor their phones while at occasions/events/parties.

The proximity alarm system may include a vibration alert alarm, a multi-tone ringing/alarm style, and a neon flashing alarm. In addition, the proximity alarm system may include multi-channels functions extendable to twelve channels and a SIM reading capability. The transmitter may include a SIM compatible embedded connector to makes the power source of the transmitter compatible with a phone battery.

The proximity alarm system may finally arrest the incessant loss or theft of handheld ICT equipment and other small but valuable objects. At present, many handheld and pocket-sized items may be not insurable due to the ease with which they may be lost or stolen. The proximity alarm system may help to reduce the risk of theft or loss of handheld and pocket-sized items and thus make them insurable by insurance companies. Thus, the proximity alarm system has the added capacity of catalyzing a deepening of the insurance industry in excess of about $23,400,000 U.S. Dollars (or ₦ 3,000,000,000 three billion Nigerian Nairas) in premium payable by mobile phone users in the first year of production.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A proximity alarm system for a cell phone, the proximity alarm system comprising:

a transmitter configured to be attached to the cell phone and having a transmitter circuit having an antenna; and a receiver having a receiver circuit having an alarm, the receiver further including a housing having a front face, a top face, and a rear face, where extending from the front face is a first arm positioned to oppose a second arm, where the first arm and second arm are configured to expand away from each other to receive a cell phone and then resiliently return towards each other to retain the cell phone, where the receiver further includes a bottom clip and an On/Off switch, each extending from the front face to function with first arm and second arm to hold cell phone in place, where the receiver further includes an alarm speaker openwork near a center portion of the front face between the first arm, the second arm, and the bottom clip, where the alarm speaker openwork includes diagonal slots enclosed within a circular perimeter, where extending from the top face are four combination dials and a deactivation button, where each combination dial is marked with numbers zero through nine and configured to be rotated so that only one number on each combination dial is closest to the front face and where each combination dial may cause the number closet to front face to be registered and stored such that, when the four combination dials are positioned to present a predetermined four digit number, the proximity alarm system may be temporarily deactivated by pressing the deactivation button, where the deactivation button is clear to allow a neon flashing light to emanate upward from the deactivation button, where attached to the rear face are a belt clip that is configured to rotate with respect to the housing, a battery compartment, a battery light emitting diode, and a data port, where the data port is configured to permit phone users to back up/store/save information on a subscriber identity module to a remote location, and where separation of the transmitter and the receiver by more than a predetermined distance is configured to cause the alarm to one of vibrate, emanate a sound, and emanate a flashing neon light, where the predetermined distance is a protected area and is one of two feet, three feet, and ten feet, and where the alarm is configured to turn off automatically when the transmitter and the receiver are back together within the protected area.

2. The proximity alarm system of claim 1, where the transmitter is embedded in the cell phone and the antenna does not physically extend external to the cell phone.

3. The proximity alarm system of claim 1, where the transmitter is configured in such a way that the transmitter functions off of 2.5 volts when utilized with the cell phone and function off 6-9 volts when utilized with an article other than a cell phone, where power to the transmitter is supplied by the subscriber identity module (SIM) voltage of the cell phone.

4. The proximity alarm system of claim 1, where the transmitter is configured to be in wireless communication with the receiver and the receiver is configured to receive incoming infrared radiation signals from the transmitter.

5. The proximity alarm system of claim 4, where the transmitter circuit includes an encoder, a first timer, a second timer, an AND gate, a first dual in-line package (DIP) switch, a second DIP switch, an output transistor, and the antenna, where the first DIP switch is a nine-position (18-pin) DIP switch connected between a ground and address pins and a ground pin of the encoder, where the first DIP switch is set with a unique binary address, where the second DIP switch is a five-position (10-pin) DIP switch connected between address/data bit pins and a transmission enable pin of the encoder and ground and an output pin the first timer, where a first input of the AND gate is connected to an output pin of the encoder and a second input of the AND gate is connected to an output pin of the second timer and where an output of the AND gate is connected to the output transistor, and where the antenna is an infrared emitter connected to the output transistor.

6. The proximity alarm system of claim 5, where the encoder is a HT-12E radio frequency remote control encoder integrated circuit, where the first timer and the second timer each are NE555 silicone monolithic timing circuits, where the AND gate is a 74HC08 quad 2-input AND gate, and where the infrared emitter is an infrared emitting diode IE-0530HP.

7. The proximity alarm system of claim 4, where the receiver circuit includes an infrared receiver, an input transistor, a decoder, a third DIP switch, a biasing transistor, an AND gate, a third timer, a decade counter, NOR gates, and the alarm, where a receiver output pin of the infrared receiver is connected to the input transistor, where the third DIP switch is a nine-position (18-pin) DIP switch connected between a ground and address input pins and a ground pin of the decoder in the receiver circuit, where an output of the input transistor is connected to a serial data input pin of the decoder, where the output pin of the decoder is fed to a base of the biasing transistor and a collector of the biasing transistor is connected to a first input of the AND gate of the receiver circuit, where a second input of the AND gate is connected to an output pin of the third timer, where an output of the AND gate of the receiver circuit is connected to a RESET pin of a decade counter, where a CLOCK input pin of the decade counter is tied to a high voltage output pin of the NOR gates, where an output pin of the decade counter is directly connected to alarm.

8. The proximity alarm system of claim 7, where the infrared receiver is infrared receiver module PIC-612S, where the decoder is a HT-12D212 radio frequency remote control decoder integrated circuit chip, where the AND gate of the receiver circuit is a 74HC08quad 2-input AND gate, where the third timer is a NE555 silicone monolithic timing circuit, where the decade counter is a CMOS 4017 decade counter, where the NOR gates is a CMOS 4001 quad 2-input NOR gate.

9. The proximity alarm system of claim 8, where the infrared receiver is configured to have a sensing distance of one of ten feet, three feet, and two feet.

10. The proximity alarm system of claim 9, where the power to the infrared emitter is adjusted to prevent infrared radiation of the infrared emitter from penetrate clothing such that the signal between the transmitter and the receiver is configured to be broken if the cell phone is put into a clothing pocket even if the distance between the transmitter and the receiver is less than two feet.

11. The proximity alarm system of claim 7, where the protected area is that area within which an emitter lobe and a receiver lobe overlap so long as emitter lobe overlaps the infrared receiver, where the protected area is configured to have a maximum distance, where maximum distance is one of two feet, three feet, and ten feet.

12. The proximity alarm system of claim 7, where as long as the decoder is receiving a valid signal from the input transistor, the output of the decoder remains high to bias on the biasing transistor, resulting in a low voltage at the first input to AND gate and when the first input to AND gate is a high voltage, a count in decade counter advances with each pulse of the third timer and causes the alarm to sound/vibrate/shine continuously until the transmitter comes back into range.

13. The proximity alarm system of claim 1, where the transmitter is configured to be in wireless communication with the receiver and the receiver is configured to receive incoming radio frequency signals from the transmitter.

14. The proximity alarm system of claim 13, where the transmitter circuit includes a dual-tone multi frequency (DTMF) signal generator circuit and a frequency modulated (FM) transmitter circuit, where the DTMF signal generator circuit includes a dialer and jumpers, where the dialer is configured to be utilized in cell phone and the jumpers are four jumper blocks connected between column pins and row pins of the dialer and configured to close and generate at least one of digits 1, 2, 4, and 8, where an output from a TONE pin of the dialer is provided as an input to the FM transmitter circuit, and where the FM transmitter circuit includes an inductor-capacitor circuit and the transmitter antenna, where the transmitter antenna is two to eight centimeters in length.

15. The proximity alarm system of claim 14, where the dialer is a dedicated UM91215B Tone/Pulse Dialer.

16. The proximity alarm system of claim 13, where the receiver circuit includes a receiving antenna, a receiver chip, the alarm as four alarms, and four amplifier transistors, where the receiver chip is a DTMF-to-binary coded decimal (BCD) converter, where each data output pin of the receiver chip is connected to one of the four alarms through an amplifier transistor.

17. The proximity alarm system of claim 16, where the DTMF-to-BCD converter is a dedicated KT3170 low power DTMF receiver chip, where the amplifier transistor is a BC548 NPN silicon transistor.

18. A proximity alarm system for an article, the proximity alarm system comprising:

a transmitter configured to be attached to the article and having a transmitter circuit having an antenna; and a receiver having a receiver circuit having an alarm, where the transmitter circuit includes a dual-tone multi frequency (DTMF) signal generator circuit and a frequency modulated (FM) transmitter circuit, where the DTMF signal generator circuit includes a dialer and jumpers, where the dialer is configured to be utilized in cell phone and the jumpers are four jumper blocks connected between column pins and row pins of the dialer and configured to close and generate at least one of digits 1, 2, 4, and 8, where an output from a TONE pin of the dialer is provided as an input to the FM transmitter circuit, and where the FM transmitter circuit includes an inductor-capacitor circuit and the transmitter antenna, where the transmitter antenna is two to eight centimeters in length, and where the receiver circuit includes a receiving antenna, a receiver chip, the alarm as four alarms, and four amplifier transistors, where the receiver chip is a DTMF-to-binary coded decimal (BCD) converter, where each data output pin of the receiver chip is connected to one of the four alarms through an amplifier transistor.

* * * * *